United States Patent [19]

Nyrup

[11] Patent Number: 4,700,551

[45] Date of Patent: Oct. 20, 1987

[54] SLICE-ICE PRODUCING MACHINE

[75] Inventor: Torsten Nyrup, Humlebaek, Denmark

[73] Assignee: Aktieselskabet Thomas Ths. Sabroe & Co., Hojbjerg, Denmark

[21] Appl. No.: 884,229

[22] Filed: Jul. 10, 1986

[30] Foreign Application Priority Data

Jul. 10, 1985 [DK] Denmark ..... 3143/85

[51] Int. Cl.[4] ..... F25C 1/14

[52] U.S. Cl. ..... 62/346; 62/354; 15/256.51

[58] Field of Search ..... 62/354, 346; 165/94; 241/166, 167; 15/256.5, 256.51

[56] References Cited

U.S. PATENT DOCUMENTS

| | | | |
|---|---|---|---|
| 2,585,020 | 2/1952 | Lessard et al. | 62/346 |
| 2,716,869 | 9/1955 | Lees | 62/354 X |
| 2,919,561 | 1/1960 | Lees | 62/354 |
| 2,961,842 | 11/1960 | Wright | 62/346 X |
| 3,092,978 | 6/1963 | Lorentzen | 62/346 X |
| 4,420,949 | 12/1983 | Bartholmey et al. | 62/354 |
| 4,512,160 | 4/1985 | Arias Mas | 62/346 X |

*Primary Examiner*—William E. Tapolcai, Jr.
*Attorney, Agent, or Firm*—Antonelli, Terry & Wands

[57] ABSTRACT

In a slice-ice producing machine of the type in which water is frozen on a rotating drum and scraped off therefrom in the axial direction by means of slightly inclined scraper knives or edges provided on a stationary knife bar, the knives are arranged in two groups of mutually opposite inclination, whereby the total forces acting on the drum and the knife bar, respectively, are drastically reduced.

4 Claims, 2 Drawing Figures

SLICE-ICE PRODUCING MACHINE

BACKGROUND OF THE INVENTION

The present invention relates to a slice-ice machine of the type having a rotating freezing drum and means for supplying water to the outside of this drum, whereby the water is successively frozen on the drum surface and moved therewith past a scraper station, in which a knife bar cooperates with the freezing drum so as to scrape off the ice by a row of stationary scraper knives, which are held so as to project almost entirely into contact with the outside of the drum, generally tangentially thereto, though with a slight inclination relative the moving direction of the drum surface. Due to this inclination of the stationary scraper knives the ice is effectively broken, without any tendency of the knives to seek inwardly towards the drum surface by the reaction pressure of the ice, whereby the drum surface could be damaged.

It is both traditional and natural to make use of a freezing drum having a vertical axis of rotation, as ii is hereby easy to supply the water to the drum in a well defined manner from a supply area, from which the water runs down along the outside of the drum such that the water freezes before its successive arrival into the scraper station, which, viewed in the direction of rotation of the drum, may be placed immediately in front of the water supply area.

In the scraper station the ice will meet a vertical row of stationary scraper knives or edges, which, due to their inclination, will act to displace the ice in the falling direction thereof, and this is sufficient for the ice to be broken into slices adjacent the single scraper knives. Thus, by the horizontal passage of the ice past the vertical scraper knife bar the ice will be broken and loosened from the drum surface throughout the area downwardly along the knife bar. The slice breaking of the ice propagates down to a certain distance underneath the single scraper knives, such that these knives need not be mounted as close to each other as corresponding to an operative overlapping or filling out of the space along the knife bar, inasfar as the ice will be effectively scraped off even when there is a certain free spacing, viewed in the axial direction of the drum or the length direction of the knife bar, between the rear end of an overlying inclined scraper knife and the front end of an underlying inclined scraper knife. Hereby the ice along the entire drum surface as passing the knife bar may be scraped down by a reasonably small number of only slightly inclined scraper knives or edges.

In connection with the present invention it has been recognized that a disadvantage, which has so far been considered as a mere operational condition, exists in the scraping action of the knives giving rise to an opposite reaction force, which affects the knife bar upwardly, and in practice this effect is quite pronounced such that the knife bar and the holding means thereof must be rather heavily dimensioned, which is correspondingly true for the associated axial support of the drum as well as the drum itself, because the drum will experience, in total, a quite considerable downwardly directed influence from the scraper knives, through the ice. All according to the character or hardness of the applied water these forces may be even very high, particularly when the produced ice is extra ductile, and in a series production of the slice-ice machines it should be aforeseen, therefore, that each of the machines may be exposed to extreme operative conditions in this respect, i.e. all of the machines should be correspondingly heavily dimensioned.

Against this background it is the purpose of the invention to provide a slice-ice machine of the relevant type, in which the discussed forces may be reduced considerably, and according to the invention this is achieved by leaving or breaking with the traditional idea of the ice generally having to be scraped off the drum in the downward direction. According to the invention it is recognized that by a scraping off of the half of the ice in the upward direction it is possible to achieve a balancing between the forces seeking to push the knife bar upwardly and the freezing drum downwardly, respectively, as the forces will then be distributed such that no considerable resulting forces will act upon neither the knife bar nor the drum. Some of the ice will be scraped off upwardly, but this is entirely unimportant for the function or the efficiency of the machine.

Principally it would be possible to hereby make use of knives of alternating upward and downward inclination, but this could lead to efficiency problems between each pair of neighboring knives if the knives are mounted just above each other. Preferably, therefore, all the knives should be uniformly oriented along one half of the knife bar and oppositely uniformly oriented along the other half of the knife bar, whereby a special situation will occur at one place only, viz. adjacent the two middle knives, which will either converge against or diverge from each other, If they diverge from each other there may be left between them a zone of non-scraped-off ice, so it is preferred to arrange the knives such that the two middle knives converge towards each other with a suitable spacing between their rear ends, whereby all the ice in the middle zone may be scraped off by the scraping action along the upper and lower edge zones thereof.

BRIEF DESCRIPTION OF THE DRAWINGS

The invention, which is more precisely defined in the appended claims, is described in more detail in the following with reference to the drawing, in which:

DETAILED DESCRIPTION

Figure 1:
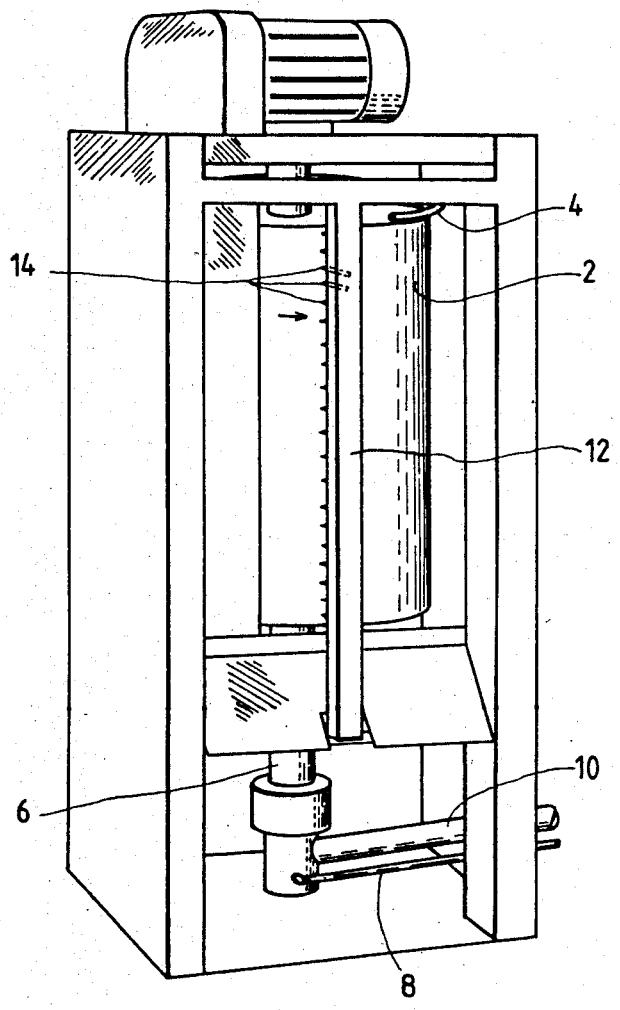
FIG. 1 is a schematic perspective view of a slice-ice machine.

The machine shown in FIG. 1 appears as a fully conventional slice-ice machine including a chassis and a smooth drum 2, which is mounted in the chasses for rotation about a vertical axis, driven by a motor shown at the top end of the chassis. Above the drum 2 is mounted a stationary nozzle tube 4, from which water is caused to run down along the smooth surface of the drum, this water supply taking place over the majority of the periphery of the drum. The drum 2 is supported by a lower bearing 6, through which the drum is connected with a supply pipe 8 for a refrigerant and a suction pipe 10 for the same refrigerant, which is preferably of the expanding type such as ammonia or Freon in a closed refrigeration system, in which the space just inside the drum surface constitutes the evaporator.

At the front side of the machine is mounted a vertical scraper knife bar 12, which carries a plurality of inwardly protruding scraper knives 14 extending almost horizontally, viz. slightly inclined relative the peripheral direction of the drum, such that the knives will hereby successively scrape off the ice as being formed on the drum surface, the rigid knives producing a vertical displacement of the ice, which is thereby loosened from the drum surface so as to fall down as slice-ice. A lower inclined plate member 16 serves to receive the falling ice and guide the ice outwardly to a receiver box or conveyor in front of the machine.

In the prior art machines of the aforementioned type the scraper knives 14 are all inclined in the same direction, i.e. they are all parallel so as to scrape off the ice downwardly, whereby, as mentioned, a considerable upwardly directed force on the knife bar 12 is produced along with a corresponding downwardly directed pressure on the drum surface.

Figure 2:
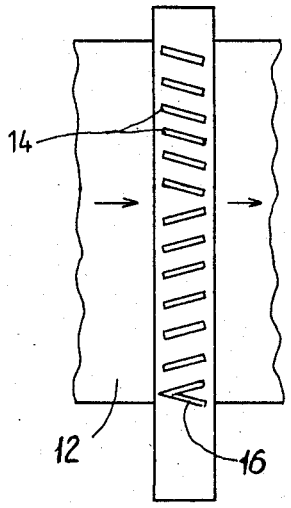
FIG. 2 is a more detailed view of a knife bar of the machine.

According to the invention as illustrated in FIG. 2 at least approximately a half of the number of knives 14 are mounted so as to be oppositely or upwardly inclined, whereby an essential reduction of the total force acting upon the knife bar and the drum surface, respectively, will be achieved, i.e. the chassis and the holding means of the knife bar may be designed correspondingly less heavily. No disadvantages are connected with the associated upwardly directed scraping off of the ice along one half of the knife bar, as these ice-slices will of course fall down anyway.

Adjacent the middle of the row of knives 14 the knives 14 change their direction of inclination. Preferably, as shown, the two middle knives 14 should converge towards each other for effectively scraping off the corresponding middle zone of ice from the drum. Of course the two middle knives 14 could be joined in a diverging, snowplough-like manner, but such an arrangement presents certain constructional difficulties. Alternatively the knives 14 could be arranged in staggered relationship in two respective vertical rows, but also such an arrangement is difficult in view of the fact that the knives 14 should extend practically exactly tangentially to the drum surface.

Although the machine has been shown and described as having a vertically oriented freezing drum this orientation is not of any major significance for the invention, and the drum with its associated knife bar, therefore, may well be otherwise oriented.

In the above described embodiment it has been found difficult to keep the lower edge area of the drum free of ice when the lowermost knife is upwardly inclined, and an improved solution is to combine this lowermost knife with a downwardly inclined knife 16 covering the lowermost edge area of the drum.

For obtaining the best result the knives 14 should be mounted with an equal number of knives 14 in the two groups, but a considerable reduction of the total forces on the knife bar and the drum 2, respectively, is achieved already when one fourth of the knives 14 are mounted with an inclination opposite to that of the remaining three fourths of the knives 14.

What is claimed is:

1. A slice-ice producing machine comprising a rotary freezing drum, means for supplying water to a drum surface of said rotary freezing drum to cause the water to freeze thereon, a scraper station comprising a knife bar cooperating with the drum surface so as to scrape off the ice by a row of stationary scraper knives projecting almost entirely into contact with the drum surface, generally tangential thereto, though with a slight inclination relative to a moving direction of an adjacent drum surface portion, such that the ice is scraped off generally in the axial direction of the rotary freezing drum, characterized in that at least approximately one-half of the scraper knives are mounted with said slight inclination directed to an opposite side of the inclination of the remaining scraper knives.

2. A slice-ice machine according to claim 1, wherein the scraper knives are mounted in a single row along said knife bar, and the scraper knives are arranged in two major groups along one and the other half of the knife bar, respectively, with the scraper knives in each group being generally parallel and the scraper knives of one group being inclined oppositely of the scraper knives of the other group.

3. A slice-ice machine according to claim 2, wherein the scraper knives are arranged so as to scrape off the ice generally towards a middle zone of the rotary freezing drum, i.e. inwardly away from the opposed ends of the rotary freezing drum.

4. A slice-ice machine according to claim 3, in which the scraper knife cooperating with an end edge area of the rotary freezing drum at one end thereof is inclined so as to scrape off the ice in a direction away from the middle zone of the rotary freezing drum.

* * * * *